United States Patent [19]

Cone

[11] 4,373,986

[45] Feb. 15, 1983

[54] GLUING MACHINE

[75] Inventor: Clendon W. Cone, Glens Falls, N.Y.

[73] Assignee: Web Graphics, Inc., Glens Falls, N.Y.

[21] Appl. No.: 253,460

[22] Filed: Apr. 13, 1981

Related U.S. Application Data

[62] Division of Ser. No. 19,332, Mar. 12, 1979, Pat. No. 4,270,967.

[51] Int. Cl.[3] ..... B65H 39/02; B31B 1/08

[52] U.S. Cl. ..... 156/552; 156/548; 270/58; 271/230; 271/243; 493/264

[58] Field of Search ..... 156/548, 552; 493/264; 270/58; 271/151, 216, 271, 275, 243, 230; 229/69

[56] References Cited

U.S. PATENT DOCUMENTS

| | | | |
|---|---|---|---|
| 2,201,539 | 5/1940 | Kast | 271/243 |
| 2,363,417 | 11/1944 | Heywood | 493/335 |
| 2,406,006 | 8/1946 | Eckhard | 271/230 |
| 2,712,441 | 7/1955 | Ray | 270/58 |
| 3,200,719 | 8/1965 | Welch | 493/355 |
| 3,540,970 | 11/1970 | Huntwork | 156/556 |
| 3,565,728 | 2/1971 | Alton | 156/552 X |
| 3,728,198 | 4/1973 | White | 156/552 |
| 3,741,085 | 6/1973 | Sutton | 493/264 X |
| 3,980,006 | 9/1976 | Welch | 493/264 X |
| 4,019,728 | 4/1977 | Liclican | 270/58 |
| 4,043,551 | 8/1977 | Morrison et al. | 271/243 |
| 4,091,987 | 5/1978 | Cone | 229/69 |

*Primary Examiner*—David A. Simmons

*Attorney, Agent, or Firm*—Blum, Kaplan, Friedman, Silberman & Beran

[57] ABSTRACT

This invention concerns an improved gluing machine and a continuous method of operation which allows the gluing process to proceed at a rate that equals the feed rate of vacuum rotary document feeders. The machine includes a unique registry and guide system for efficiently moving documents fed initially in an individual manner in a continuous, flowing manner from an initial input feed device to the gluing and registry point with the carrier. The feed system not only allows substantially greater operating speeds but simultaneously overlaps documents while establishing and maintaining correct registration of the documents. The documents are overlapped so that following documents are positioned beneath leading documents. This overlapped condition together with the registry achieved within the feed system assures each individual document arrives in proper registry with areas of glue previously applied at preselected intervals on the carrier sheet. The machine also includes a unique collection and refolding station for the carrier sheet and the documents attached thereto.

17 Claims, 13 Drawing Figures

276
278
C
280
290
289
288
286
284
282
22
292
294
296
20
52
196
144
50
110
260
262
48
122
194
C
E
24
216'
63'
198
63
202
46
187
116
64
14
108
44
16
E

GLUING MACHINE

This is a divisional of application Ser. No. 019,332, filed Mar. 12,1979, now U.S. Pat. No. 4,270,967, issued June 2, 1981.

BACKGROUND OF THE INVENTION

Since the advent of automated word processing machinery beginning with the earliest automatically controllable typewriters and continuing on through the more sophisticated memory type word processing devices presently available there has been an increasing demand to provide a continuous supply of documents on which information can be put. The documents and work involved includes the automatic processing of business forms such as bills, the typing of letters on letterhead stationery, the addressing of envelopes as well as other types of repetitive work. In recent years, the preferred method of making such documents or business forms readily and continuously available has been by attaching them to a continuous carrier sheet which will transport them through the word processing equipment and from which they are subsequently removed following such processing.

There are a number of problems that must be overcome to properly prepare this document and carrier sheet product. The primary problem is registration. It is, of course, essential for typewritten material to be properly placed on each successive business form, such as bills. Thus, with each successive indexing movement of the carrier sheet through a word processor the next form must not only appear at the correct place, but it must also be correctly oriented on the carrier sheet both vertically and horizontally. Accordingly, it is necessary to properly attach such business forms to these carrier sheet substrates at precise locations and with a particular orientation.

Thus, at least one key element in the process of attaching forms or documents to carrier sheeting is to properly register each successive form at a predetermined position in the feed system and to develop and maintain the correct orientation so the document can be correctly placed on the carrier sheet substrate. When this is done each form subsequently coming into the word processor will be correctly positioned to receive information in the right location.

It is well recognized in the paper forms industry that documents feeders, such as rotary vacuum feeders, operate at relatively fast rates. Heretofore, it has not been possible to operate machines which attach documents to continuous carrier sheets at speeds comparable to those at which these feeders operate and still maintain registry of the documents. In one of the best known gluing machines, documents are essentially individually handled by a mechanical system. Each document is picked off from the bottom of a stack by a plurality of suction elements. The suction elements move the leading edge downwardly to a position where a plurality of gripping fingers can grab the document. The fingers are mounted on an arm which when moved pulls individual documents from the stack and moves them to a position above the carrier sheet on which glue spots had been previously placed. Movement of this finger arm is in a stop and go manner since the arm stops adjacent the supply and also when positioned above the carrier sheet. Accordingly, this provides a very slow feed but such a rate was necessary to allow documents to be correctly registered.

In order to produce an output rate that was acceptable relative to machine cost, prior art machines often employed multiple feed streams or paths so that several carrier sheets were being supplied simultaneously with documents from separate sources. Such multiple path devices were not without problems, however, since each path was driven from a common drive so that like documents had to be used in each stream. Also, if a problem of any kind developed in one stream requiring feeding to be stopped, the other stream was also rendered inoperative.

Such machines operating with two feed lines operating at an output rate of about 3300 documents per hour per stream produced a total hourly output of about 6600 documents.

Thus, it is extremely important to be able to accomplish gluing procedures in a relatively short amount of time not to make most efficient use of machine time and labor but in order to properly utilize the operational capabilities of rotary vacuum feeders.

Another problem concerns the difficulty in feeding documents so that lead documents are overlapped by following documents with the following document beneath the lead document. By overlapping documents in this manner, the leading edge of each document can be correctly positioned, documents are more easily oriented and documents are able to be correctly placed on the carrier sheet so that the trailing portion of leading documents lies on top of the leading portion of following documents.

SUMMARY OF THE PRESENT INVENTION

The present invention provides a novel process and apparatus for use in forming carrier sheet constructions which creates extremely fast flow rates for documents so that the full output speed of rotary vacuum feeders can be effectively utilized. The present invention not only provides a process and apparatus for creating this rapid flow of documents but also provides and effective overlapping guiding and registering system for properly positioning documents as they are received in an individual fashion from the rotary vacuum feeder. Further, the present invention places documents in an overlapped and registered condition within the feed system which is continued and maintained on the carrier sheet. Further, the documents and carrier substrate both remain in continuous motion from the time each is fed until the final carrier sheet construction including attached documents is refolded at the end of the process.

The present method and apparatus for establishing this continuous flow and proper registration is comprised initially of upper and lower feeding systems. The upper feeding system will be referred to as an overhead register rack while the bottom system will be called a bottom conveyor assembly. The bottom conveyor assembly has two separate belt systems. One system includes a plurality of conveyor belts and the other includes a plurality of narrower belts which support a multiplicity of spaced apart alignment members which are positioned perpendicularly to the flow direction. Because of the type of overlapping used here where following documents lie beneath leading documents, each of these alignment members intercept the leading edge of one document as it is fed from the document feeder and provides the initial means for placing each document in proper registry. These alignment members also cause the trailing portion of leading documents to overlap and lie above the leading portion of trailing documents. Preferably this overlap is at least about one quarter inch.

The overhead register rack includes at least two drive belts across which are connected a plurality of alignment bars which are also positioned normal or perpendicular to the flow direction. Included on certain ones of these bars is at least one ball bearing held in the alignment bar in a floating manner. The bars in the overhead registry rack are arranged to cooperate with those of the bottom assembly so that at least one alignment bar in the overhead register rack arrives at a position above the leading portion of the document upstream from an alignment member in the bottom conveyor assembly.

When the alignment bars are facing documents, the floating ball will have moved by gravity onto the mounting structure which secures it to the alignment bar. At this point, however, the ball will extend downwardly beyond the bottom surface of the bar and freely rotate. When the alignment bar is spaced above the document only the floating ball engages the surface of the document. This creates light vertical pressure on the leading portion of the document and holds the document on the bottom conveyor assembly. However, the vertical pressure is not great enough to prevent the document from moving in a horizontal fashion both in a machine and cross machine direction. In that regard, it should be understood that the phrase "machine direction" refers to the direction in which the document is moving from the feed device toward the area where it will be placed into contact with the carrier sheet whereas the phrase "cross-machine direction" refers to movement normal to the feed direction or from one side of the machine toward the other. This ability for each document to move in a horizontal direction allows registration to be effected during feeding and allows proper registration to be easily maintained.

Since documents are continuously flowing from the feeding device until they come into contact with the carrier sheet, and further, since the distance between these two points is relatively short, travel time is likewise relatively short. Accordingly, it is most desirable if the achieving of proper and correct registration does not have to occur immediately as documents are received between the bottom conveyor assembly and the overhead registry rack. As can be appreciated, the ability to continuously effect proper registration while documents are flowing or moving allows operating speeds to be dramatically increased.

As documents move in the machine direction their leading edges are adjacent alignment members on the bottom conveyor assembly and the leading portion is under vertical control. The separate set of conveyor belts provided in the bottom conveyor assembly are moved at a slightly faster rate than the belts containing the alignment members so that these belts continuously urge documents in the machine direction during document travel toward the alignment members. This not only helps complete the proper orientation and registration of documents while they are being fed, but maintains contact between each document and one of those members. It should also be noted, that the registration and orientation achieved in the feed system is substantially if not exactly the same as after the documents are attached to the carrier sheet substrate. Guide rails are provided along the side of the flow path between the bottom conveyor assembly and the overhead registry rack in order to provide proper cross-machine orientation. Thus, by the time documents and the carrier sheet come together, each document will be aligned and in proper registry with areas of glue previously applied at particular locations on the carrier sheet. Documents are pressed into contact with the glued area on the carrier sheet and together are guided to a collection area where the carrier sheet is refolded.

Additional objectives and significant characteristics of the present invention as well as the novel elements of a combination which comprising the present invention will become more fully understood when the following specification is read in conjunction with the drawings which include:

DETAILS AND DESCRIPTION OF THE PREFERRED EXEMPLARY EMBODIMENT

Figure 1:
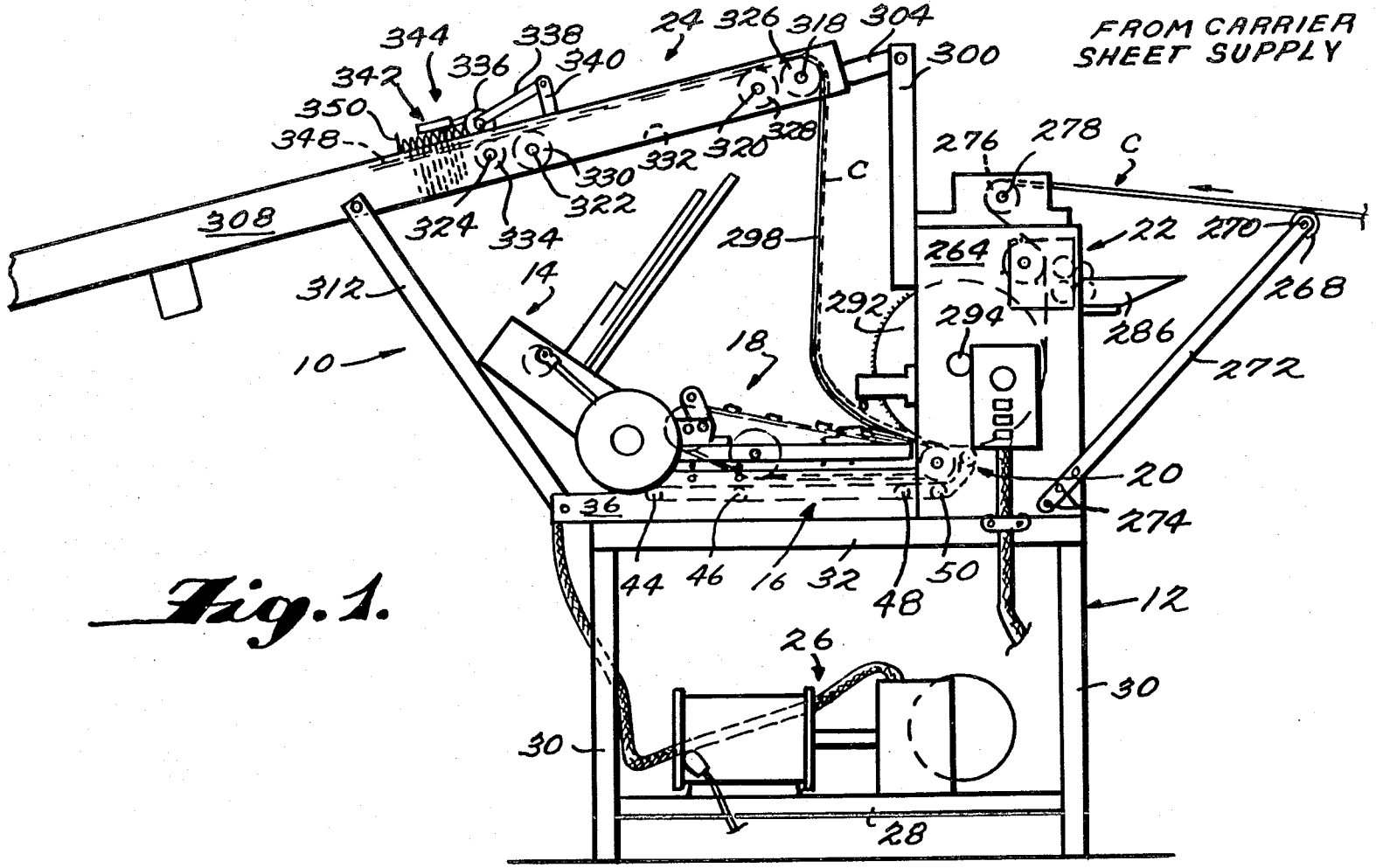
FIG. 1 is a diagrammatic side elevational view of the preferred exemplary embodiment of the present invention.
Figure 2:
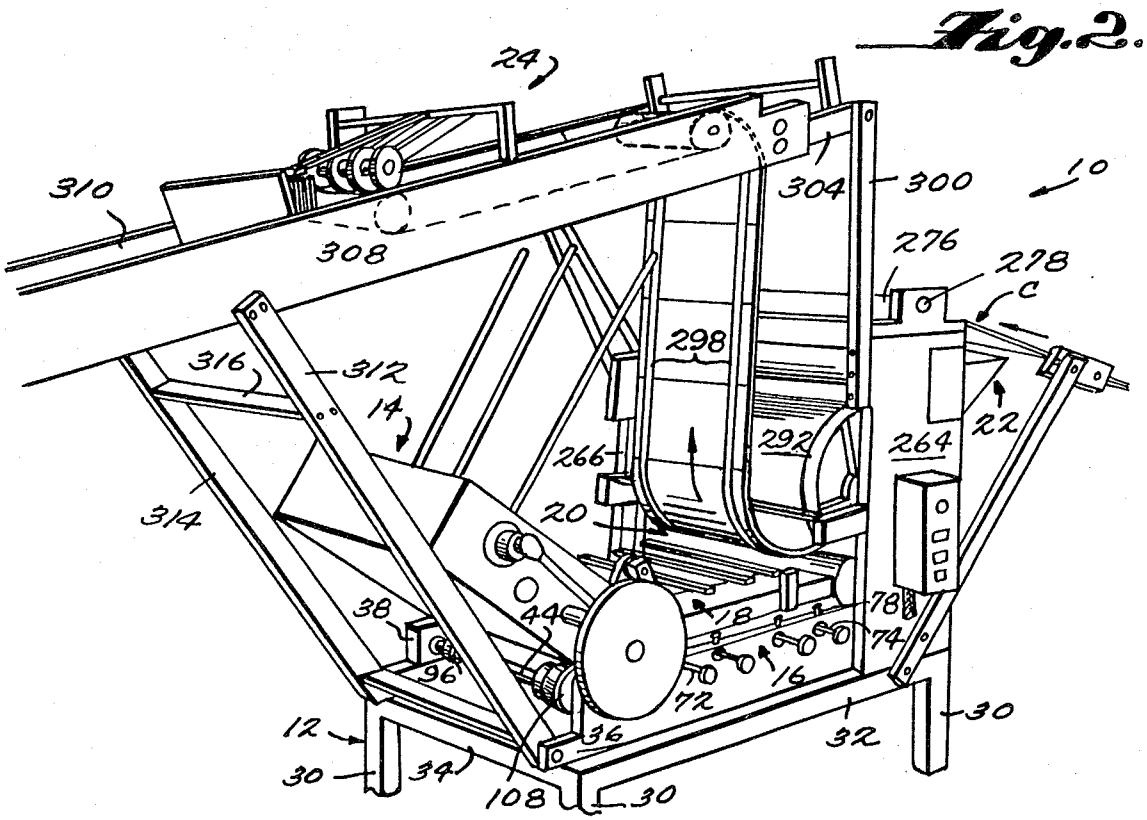
FIG. 2 is a diagrammatic perspective view of a portion of a preferred embodiment as shown in FIG. 1.

Turning now to FIGS. 1 and 2 the gluing machine constructed according to the present invention is generally indicated at 10 and includes a number of separate subassemblies such as a frame assembly, generally indicated at 12, a feed assembly, generally indicated at 14, a bottom conveyor assembly, generally indicated at 16, and an overhead register rack assembly 18. The bottom conveyor assembly 16 and the overhead register rack assembly 18 cooperate to deposit documents at the compression or gluing station, generally indicated at 20, where the documents contact a continuous carrier sheet, C, on which glue has been deposited at spaced apart intervals by a glue applicator assembly generally indicated at 22. Thereafter, the carrier sheet with attached documents is collected in a collection assembly, generally indicated at 24, while the collection assembly 20 is shown as being located above and to one side of the machine 10. It should be understood that other positions could be used.

The power and drive assembly, generally indicated at 26, can be conveniently located on a bottom shelf 28 which forms part of frame assembly 12. As shown in FIG. 2, frame assembly 12 can also include legs 30 and an upper portion for supporting the machine comprised of side members 32 and end members 34.

Feeding assembly 14 can comprise any one of a number of conventional type feeding devices and in order to obtain the best operating speeds is preferably a rotary vacuum feed type. An exemplary feeder of this type is the Halm Jet or Super Jet model, rotary vacuum feeder, manufactured by the Halm Instrument Co., Inc. located in Glen Head, N.Y. Other feeding devices which can be used with the present invention are described in U.S. Pat. Nos. 3,796,426, 3,497,205 and 2,704,209.

Located between feeding assembly 14 and the compression station 20 is a unique feed mechanism formed by the coordinated operation of bottom conveyor assembly 16 and the overhead register rack assembly 18. Turning now to FIGS. 1–4, bottom conveyor assembly 16 includes a frame formed from side members 36 and 38 and a front end wall 40 secured to side members 36 and 38 as for example by bolts 42. A plurality of shafts 44, 46, 48, 50 and 52 extend between side members 36 and are rotatably supported in bearings (not shown). These shafts cooperate to support conveyor belts 54, 56 and 58, aligning belts 60 and 62 and a main drive belt 64. Conveyor belts 54 and 58 are designed so as to be inboard of a one-piece side guide 66 and side guide 68 and 70 mounted on the opposite side of the bottom conveyor belt assembly 16. Side guide 66 is mounted on bars 72 and 74 which extends transversely across the assembly 16 and are slidably mounted in sidewalls 36 and 38. Specifically, side guide 66 is pivotally mounted to each of the bars 72 and 74 by means of a pin which extends through each of the bars and which fits into a block mounted to the bottom of guide 66. In addition, bars 72 and 74 can be fixed in position by means of thumb screws 76 and 78, respectively. Springs 80 and 82 are also provided about bars 72 and 74 to aid in adjusting side guide 66. Side guides 68 and 70 are slidably supporting on bars 72 and 74 while the opposite end of each side guide is supported, respectively, by bars 84 and 86 which are slidably retained in sidewall 36 and whose movement is controlled by thumb screws 88 and 90. Each of the side guides 68 and 70 is also provided with a leaf spring 92 and 94, respectively, and bars 84 and 86 can be horizontally adjusted so as to bring springs 92 and 94 into a slight touching engagement with the side of documents so that the opposite side of that document is just slightly touching side guide 66.

Conveyor belts 54, 56 and 58 are respectively supported by pairs of pulleys 96 and 98, 100, 102 and 104 and 106. The main drive belt 54 is supported by pulleys 108 and 110. Alignment belts 60 and 62 are respectively supported and driven by pulleys 112 and 114 and 116 and 118.

As indicated previously, shaft 48 is journaled in sidewalls 36 and 38 and serves to support two pulleys 120 and 122. Shaft 52 is rotatably supported in support members 124 and 126 which are respectively connected to mounting brackets 128 and 130 by means of bolts 132. Mounting brackets 128 and 130 can themselves be affixed to end wall 40 by any convenient means such as welding. Pulleys 134 and 136 are supported by shaft 52 and together with pulleys 138 and 140 drivingly support gripping belts 142 and 144.

Shaft 50 is the main drive shaft and is connected to a drive system, in a manner to be more fully discussed hereinafter, by means of a main drive pulley 146 mounted on shaft 50 exteriorly of sidewall 38.

Support blocks 148 and 150 are secured to sidewall 38 by any convenient means such as screws whereas support blocks 152 and 154 are secured in a similar manner to sidewall 36. Support blocks 148 and 152 support a member 156 which is attached to support blocks 148 and 152 by any convenient means and support blocks 150 and 154 support member 158 in a similar manner. Members 156 and 158 extend across the width of assembly 16 and serve to support a support plate 160 which serves to help support documents in alignment belts 60 and 62. Support plate 160 is provided with two U-shaped cutouts 162 and 164 which open toward member 156 and through which drive pulleys 112 and 116 operate.

Figure 8:
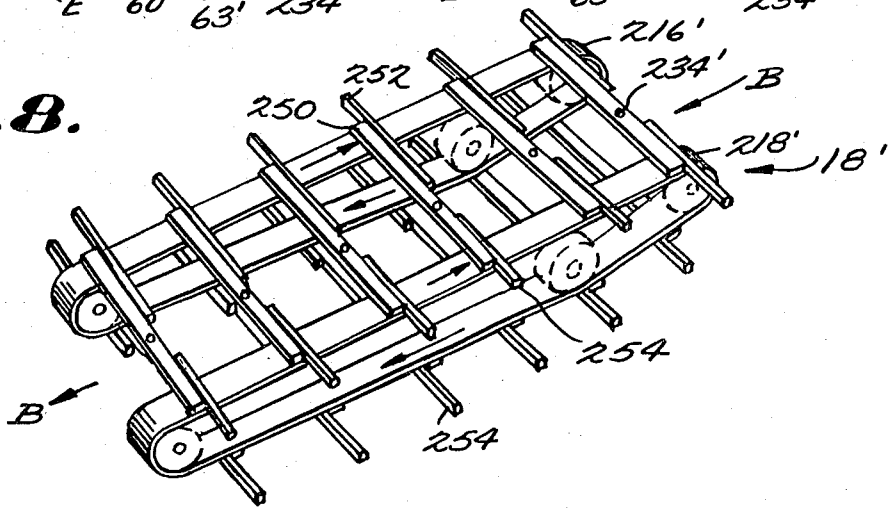
FIG. 8 is a diagrammatic perspective view of the overhead registry rack designed to handle envelopes.

The gluing device is designed to handle either long type business forms, principally letterheads or short types of business forms, principally envelopes depending upon the overhead registry rack that is used. The overhead registry rack assembly for each of these types of business forms will, of necessity, be slightly different in size although the concepts remain the same. The overhead registry rack assembly used in gluing long business forms is shown in FIG. 6 whereas the overhead registry rack assembly for applying short business forms is shown in FIG. 8.

Figure 6:
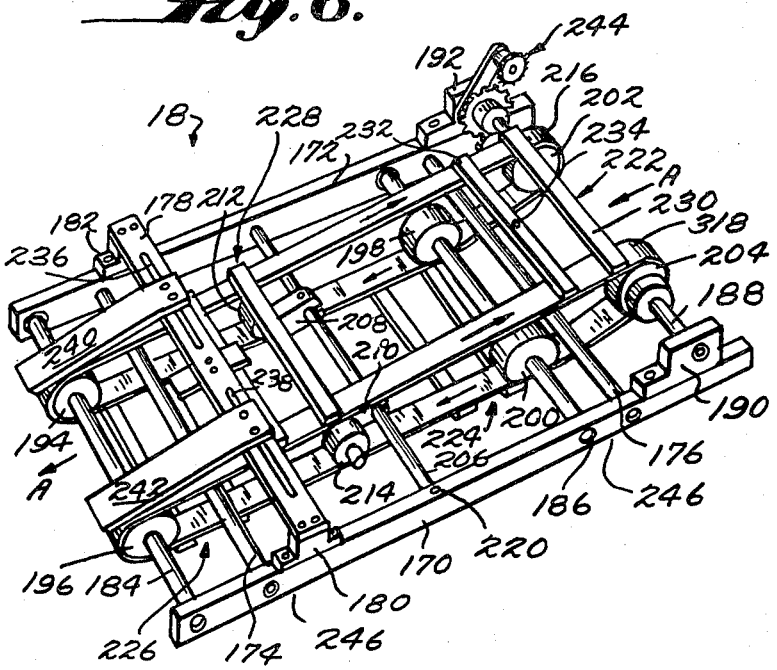
FIG. 6 is a diagrammatic perspective view of the overhead registry rack used when the machine is set to run letterhead or long sheet-type business forms or documents traveling in the direction of arrows A—A.
Figure 7:
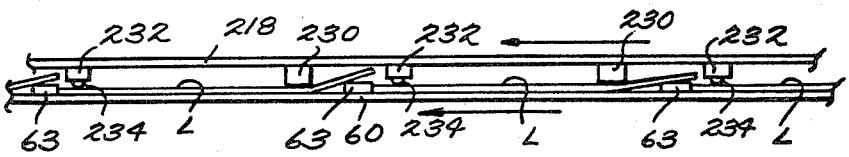
FIG. 7 is a diagrammatic side elevational view of the conveyor belts of the overhead registry rack and the bottom conveyor assembly designed to handle letterheads.

Turning first to FIGS. 6 and 7, the overhead registry rack assembly moves documents in the directions shown by arrows A—A and is generally indicated at 18 and is comprised of side members 170 and 172. Side members 170 and 172 are spaced apart by fixed shafts 174 and 176 and by support bar 178 the ends of which are secured to side members 170 and 172 by means of mounting brackets 180 and 182, respectively. Three drive shafts 184, 186 and 188 are rotatably supported between side members 170 and 172 with shaft 188 being raised at a level above shafts 184 and 186 and being supported within blocks 190 and 192 themselves being secured such as by bolts or screws to side members 170 and 172.

Drive shaft 184 serves to support drive pulleys 194 and 196, drive shaft 186 supports guide pulleys 198 and 200 while driven shaft 188 supports drive pulleys 202 and 204.

A mounting bar 206 extends between side members 170 and 172 about midway along their length and serves to support connecting arms 208 and 210 which respectively have rollers 212 and 214 rotatably mounted thereto. A drive belt 216 is supported by pulleys 194, 198 and 202 while a second drive belt 218 is supported by pulleys 196, 200 and 204. Rollers 212 and 214 respectively can be pivoted into a position so as to tension and properly position belts 216 and 218 with shaft 206 being held in place by means of Allen screws 220.

Four sets of aligning or hold down bars are provided on this overhead registry rack assembly and are generally indicated at 222, 224, 226 and 228. Each set includes a solid bar 230 and a second bar 232 which is provided with a ball bearing 234 mounted therein so that it can float within its mounting.

Solid bars 230, as shown in FIG. 7, are positioned so as to travel slightly ahead of lugs 63. Relatively long letterhead size documents are usually flexible or limp and to assure the creation of an overlap, by leading documents over trailing documents, bars 230 cause a document's trailing edge to be raised up on top of the next lug 63. This overlap is preferably of at least about one quarter of an inch.

Bars 232 include a ball bearing which will, when bar 232 is adjacent belts 60 and 62, as shown in FIG. 7, drop under its own weight in its mounting so as to just touch the upper, exposed surface of the sheet of letterhead. This provides a slight vertical pressure on the forward portion of the letterheads adjacent the leading edge which preferably rests against and is in alignment with lugs 63. We have found that it is important to have this slight amount of vertical pressure adjacent the leading edge and in the forward portion of the letterhead size documents. However, such vertical pressure should allow the documents to move horizontally including forward toward alignment lug 63 and also side to side in order to allow for horizontal registration by side guides 66 and 68 and 70, respectively.

The gearing on conveyor belts 54, 56 and 58, referring back to FIG. 4, is such that those belts tend to operate at a faster rate than aligning belts 60 and 62. Preferably, this rate difference is on the order of 15 to 20% and since aligning lugs 63 prevent forward movement of the documents located therebehind, belts 54, 56 and 58 will tend to slip beneath the document thereby not only urging the leading edge toward the aligning lug but will also maintain alignment of the leading edge of those lugs. By using floating balls 234, it is therefore possible to achieve correct horizontal registration of each of the documents during its travel from the feeding assembly 14 to the compression section 20.

Mounting bar 178 is provided with two mounting slots 236 and 238 in which two angled plates 240 and 242 can be mounted so that if necessary they can be moved horizontally into a correct position. Plates 240 and 242 are located at the front end of the overhead registry rack assembly 18 and serve to catch doubles which are not attached to carrier sheet C in the compression section 20. In those instances, where the feeding assembly 14 will feed two documents, only the bottom document will be attached to the carrier sheet C and as the documents leave the compression section 20 the flow path leaving that section is out over the registry rack assembly 18. In order to catch the document which is not attached and which will drop away from the attached document and the carrier sheet, these plates 240 and 242 are provided in order to catch the document thereby preventing it from fouling further the continued operation of the registry rack assembly 18.

Also provided on the overhead registry rack assembly 18 are drive gears generally indicated at 244 which are driven by feeding assembly 14 and serve to provide the driving power for shaft 188.

It should be noted that each of the sets of hold down bars 222–228 have a construction similar to section 22 and, accordingly, further description thereof is not deemed to be necessary.

The overhead registry rack assembly is also provided with support posts 246 on the bottom of side members 170 and 172 which align with mounting blocks 148–154 provided in the bottom conveyor assembly 16 and serve to mount the overhead registry rack assembly 18 within the machine 10.

Figure 9:
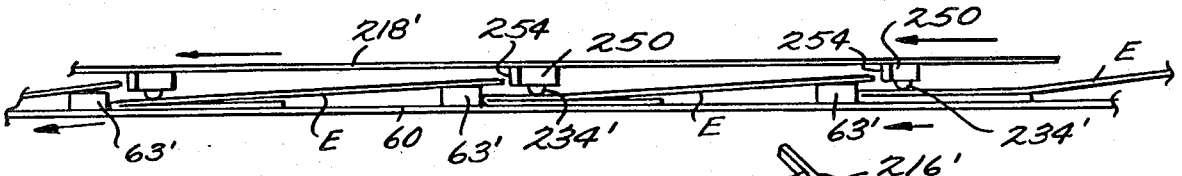
FIG. 9 is a diagrammatic side elevational view of the conveying belts in the overhead registry rack and the bottom conveyor assembly designed to operate with envelopes.

Turning now to FIGS. 8 and 9 which is designed for short business forms and principally envelopes, the registry rack assembly 18' is constructed in a manner similar to that just described above and is shown in FIG. 6. Two belts 216' and 218' are rotatably supported in a similar fashion as are belts 216 and 218. The assembly 18' differs, however, from the unit shown in FIG. 6 by having a plurality of hold down and aligning bars 250 which are secured to belts 216' and 218' and extend thereacross. Each bar 250 is provided with a floating bearing 234' and each bar has a pair of outrigger bars 252 and 254 secured to either end and on the leading side thereof. Documents move in the direction shown by arrows BB so that as each bar passes from the top of the assembly to the bottom thereof an envelope will have been fed and be intercepted so its leading edge is adjacent alignment lug 63 on belt 60. Substantially simultaneously bar 250 will arrive at a position above the leading portion of the just fed envelope E with floating balls 234 again just touching the envelope thus providing a slight vertical pressure on the leading portion of each envelope.

The bottom conveyor assembly 16 will be the same in each instance except for the aligning belts 60 and 62 which will be changed to provide different spacing between aligning lugs 63' to correspond to the length of envelopes E. It should be noted that the spacing between alignment lugs 63 used with letterhead size documents or forms will be 10½ inches whereas the spacing between alignment lug 63' used with envelopes or short forms will be about 3½ inches. It is only essential that the spacing between alignment lugs on belts 60 and 62 be spaced from one another about half an inch less than the length of the document being handled in order to create the desired overlap. Thus, if envelopes other than a standard size 4 inch envelope are being worked with the spacing between lug 63' would be varied accordingly. The same is true regardless of the type of document being fed in that the alignment lugs can be spaced apart a distance which is about half an inch less than the length of that document.

Again, the conveyor belts 54, 56 and 58 are arranged to move at a speed slightly greater, about 15 to 20 percent, than the speed at which alignment belts 60 and 62 move so that conveyor belts 54–58 tend to slip beneath the item being fed thereby forcing the leading edge into an abutting relationship with the alignment lugs. Because of the specific construction of bars 250 and in particular because of the presence of floating balls 234', envelopes E can move in a horizontal direction toward alignment lugs 63' notwithstanding the slight vertical pressure applied by floating balls 234. The action of belts 54–58 tends not only to establish the correct positioning and registration of the leading portion of the envelope but maintains that registration throughout this feeding sequence.

With reference to FIGS. 7 and 9 sheets of letterhead and envelopes are positioned between respective conveying belts so that the trailing portion of the document or envelope rests upon the alignment lug which next follows the one against which the leading edge of that document abuts thereby raising the trailing edge. This assures that the next incoming document or envelope will have its leading edge located beneath the trailing edge of the preceding document or envelope so that it can properly abut and be aligned by the abutment lug 63 or 63'. As indicated above this overlap will preferably be at least about one quarter of an inch.

Returning once again to FIGS. 1–4, when the item which is to be attached to carrier sheet C leaves the feeding area defined by bottom conveyor assembly 16 and one of the overhead registry rack assemblies 18 or 18', the document is delivered into gripping belts 142 and 144 which extend around a portion of the periphery of compression roll 260 which is mounted on shaft 262 which is rotatably supported between vertical members 264 and 266 which are respectively connected to side members 36 and 38 of the bottom conveyor assembly 16 and frame 12.

The carrier sheet C comes from its own separate source of supply (not shown) and is initially guided toward machine 10 by guide roller 268 rotatably attached by a pin or shaft 270 to outrigger arms 272 and 273 which are attached to the base of vertical members 264 and 266 by any convenient means such as screws 274. The carrier sheet, after leaving roller 268, passes around another guide roller 276 mounted on shaft 278 which is supported between vertical members 264 and 266.

Figure 3:
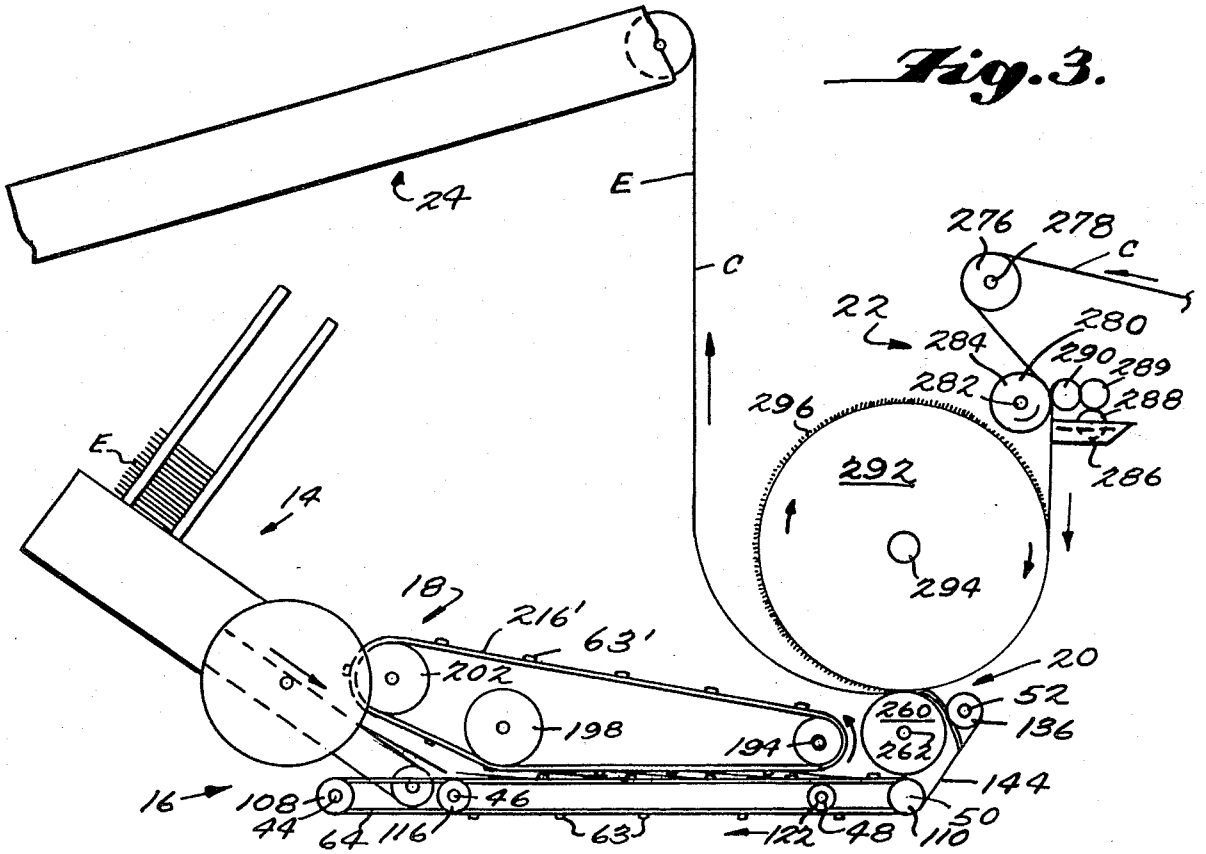
FIG. 3 is a diagrammatic side elevational view of the overhead registry rack and the bottom conveyor assembly as used in the preferred embodiment of the present invention as shown in FIG. 1.

After passing around guide roller 276, the carrier sheet C passes through a gluing assembly 22 which, as shown best in FIGS. 1 and 3, is comprised of a main gluing roller 280 rotatably supported by shaft 282 which is itself journaled within vertical members 264 and 266. Roller 280 is provided with a plurality of upstanding ribs 284 which project a predetermined distance away from the surface of roller 280. A supply of glue is held in tray 286, secured between vertical members 264 and 266. In order to transfer or use only limited and precise amounts of glue, glue application is accomplished by employing glue transferred by a pick-up roller 288 which is positioned so as to have a portion of its surface immersed in the glue. The surface of roller 288 is kissed by a transfer roller 289 which in turn is in surface contact with the main transfer roller 290. Both pick-up roller 288 and transfer rollers 289 and 290 are also rotatably mounted so as to extend between vertical members 264 and 266 with main transfer roller 290 being positioned adjacent roller 280 so that as the projections 284 which extend across the full length of roller 280 come into contact with the carrier sheet C, the carrier sheet will be pushed momentarily into contact with the exterior surface of transfer roller 290. During this brief period in which the carrier sheet C is in contact with transfer roller 290, glue is picked up on the surface of carrier sheet C in whatever pattern the raised member 284 establishes therebehind. It should be noted that the spacing of projections on roller 280 depends on whether letterhead size documents or envelopes or short form documents are being fed.

After leaving gluing assembly 22, the carrier sheet with glued portions on the exterior side passes about a main guide and drive roller 292 which is journaled or rotatably mounted between vertical members 264 and 266 by a central shaft 294 located downstream from the gluing assembly 22. Roller 292 is provided, at least around the periphery of one side, with pins 296 for driving the carrier sheet C which is provided along each edge with a plurality of perforations known as lineholes which are spaced apart about ½ an inch. Roller 292 comes into contact with compression roller 260 and the bottom conveying assembly 16 and the overhead registry assembly 18 will correctly deposit envelopes or letterheads, depending upon which is being fed, alignment with the glue earlier placed on carrier sheet C. As the glue area and the document or envelope simultaneously arrive at the compression point between rollers 260 and 292 the document or envelope will be pressed onto the carrier sheet. Thereafter, the carrier sheet, with documents or envelopes attached, will be carried vertically and guided by guides 298 toward collection assembly 24.

Figure 5:
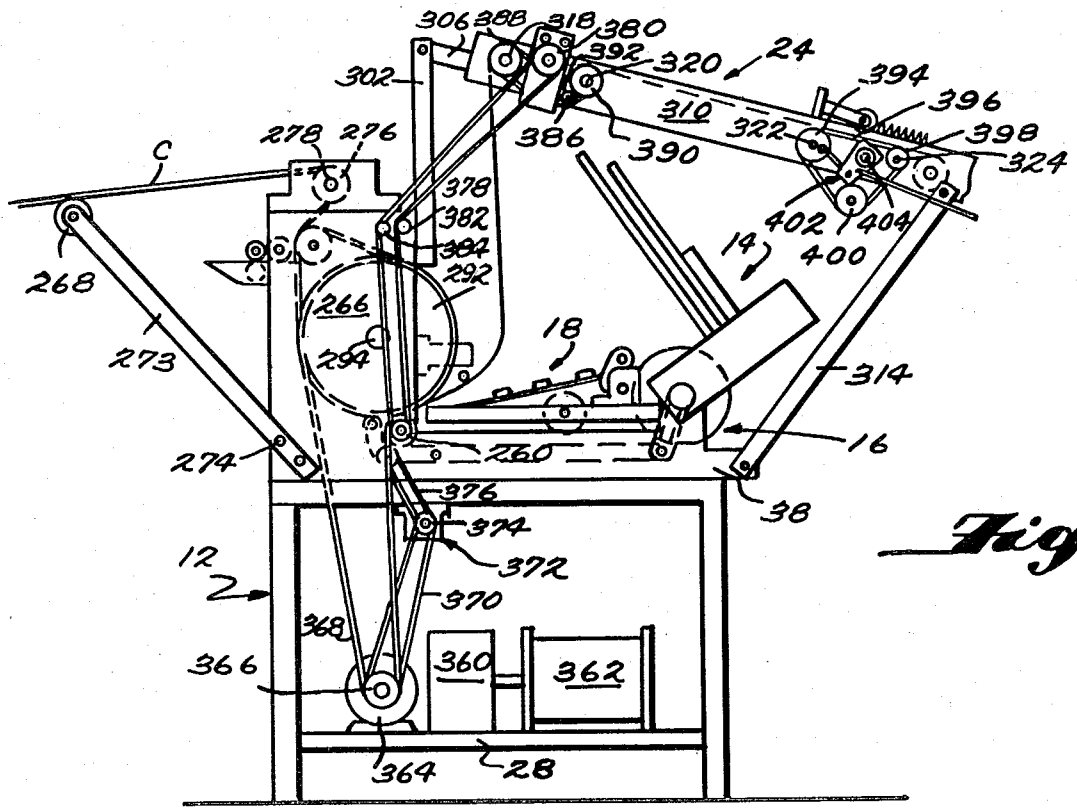
FIG. 5 is a diagrammatic view of the drive means used in the present invention.

One end of collection assembly 24 is supported by vertical members 264 and 266 and support arms 300 and 302, as shown in FIGS. 1, 2 and 5. Angled support arms 304 and 306 are mounted to the top portion of vertical arms 300 and 302 and arms 304 and 306 respectively support side mounting plates 308 and 310. Side plates 308 and 310 are also supported by braces 312 and 314 which are attached to side members 36 and 38. For additional support cross braces, such as is indicated at 316, can be used between braces 312 and 314.

Figure 11:
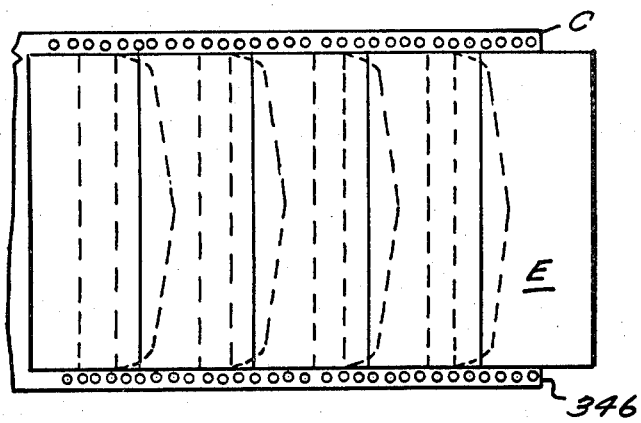
FIG. 11 is a top plan view of envelopes attached to a carrier form.
Figure 12:
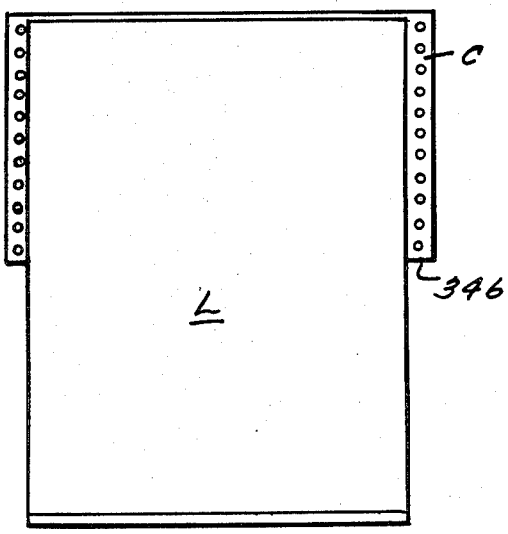
FIG. 12 is a top plan view of letterheads attached to a carrier.
Figure 13:
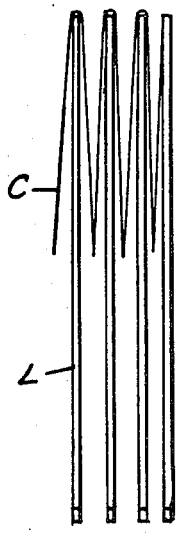
FIG. 13 is a side view of the construction shown in FIG. 12.

Journaled between side mounting plates 308 and 310 are shafts 318, 320, 322 and 324. Shaft 318 supports a guide roller 326 which provides the initial entry into collection assembly 24. Shafts 320 and 322 support pairs of pulleys 328 and 330 with each pair serving to drivingly support a conveyor belt 332. Shaft 324 serves to support a roller 344, which is preferably divided into a plurality of segments which associate with a plurality of pressure rollers 336 mounted thereabove by means of a connecting arm 338 and a mounting bracket 340 which is affixed to and extends cross side mounting plates 308 and 310. Also, a stop device, generally indicated at 342, is provided to sense when a jam occurs in the refold section of the collection assembly, the refold section generally indicated at 344. As the conveyor sheet C passes over guide roller 326 it is carried down conveyor belt 332 and passes between rollers 334 and 336 where the segmented carrier sheet is refolded, as is shown. Carrier sheet C, when it is refolded, as shown in FIG. 12, has a shoulder generally indicated at 346 where it extends beyond the side of the document or envelope as indicated in FIG. 11. This shoulder portion 346 is carried or supported by support guides 348 which extend along the length of mounting plates 308 and 310 downstream from the refolding section. In addition, a movable support plate 350 is slidably mounted between mounting plates 308 and 310 and moves in a rearward direction away from the refolding area 344 and serves to keep the refolded carrier sheet and the attached documents in a neatly folded condition.

Figure 10:
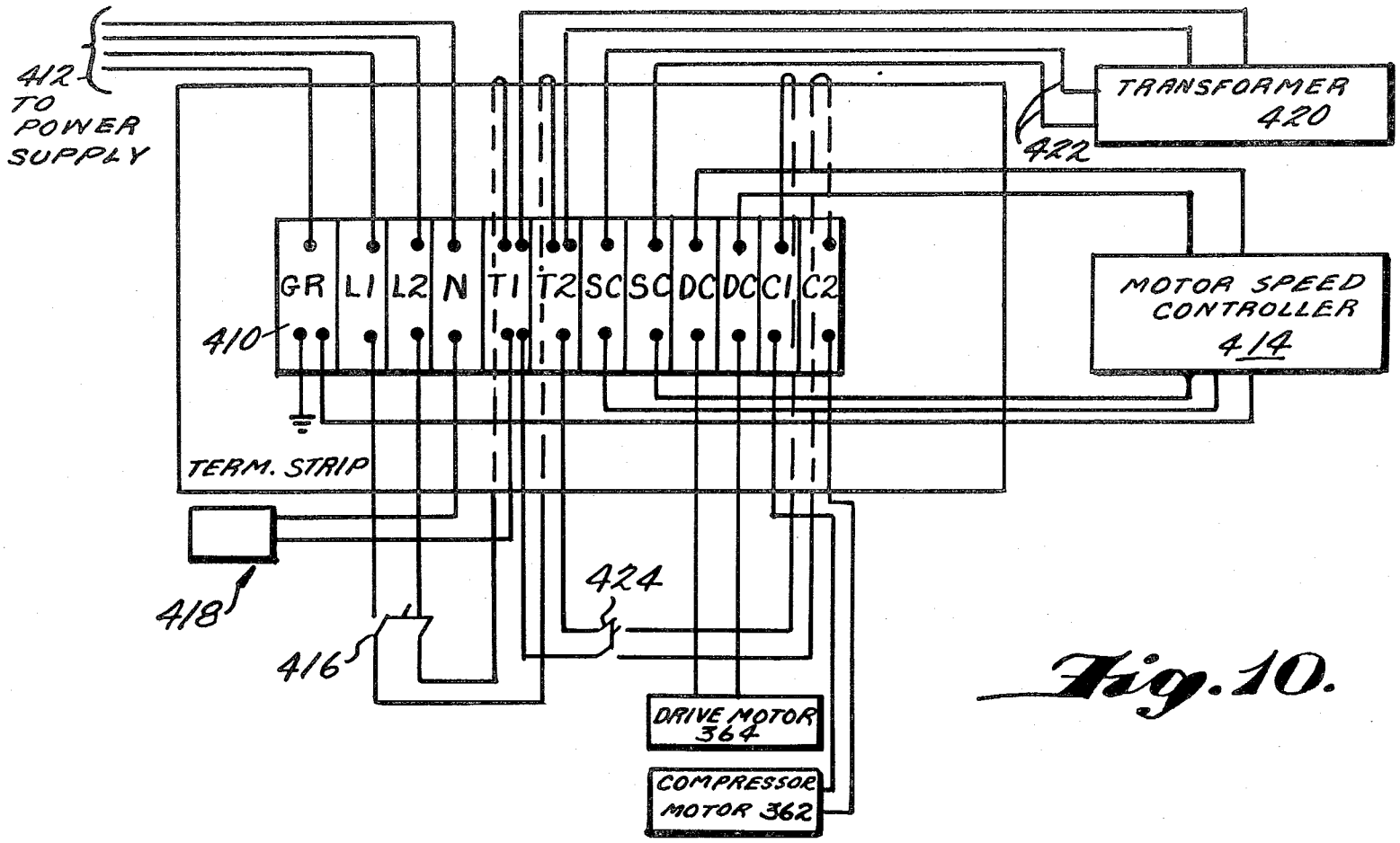
FIG. 10 is a diagram of the electrical diagram showing the terminal strip connection sequence for the preferred embodiment as shown in FIG. 1.

The drive and electrical systems for this device are shown respectively in FIGS. 5 and 10. Turning now to those figures, the compressor for providing vacuum to the feed device 14 is indicated at 360 and is powered by a compressor motor 362. Preferably, both the compressor 360 and the compressor drive motor 362 are located on shelf 28. The main drive motor 364 is also located on shelf 28 and connected to a main drive pulley 366 are two main drive belts 368 and 370. Drive belt 368 extends around and serves to drive rollers 280, 266 and 260 prior to returning to the main drive pulley 366. Accordingly, the main roller 366 compression roller 260 and the main glue roller 280 are all driven at the same rate of speed.

Figure 4:
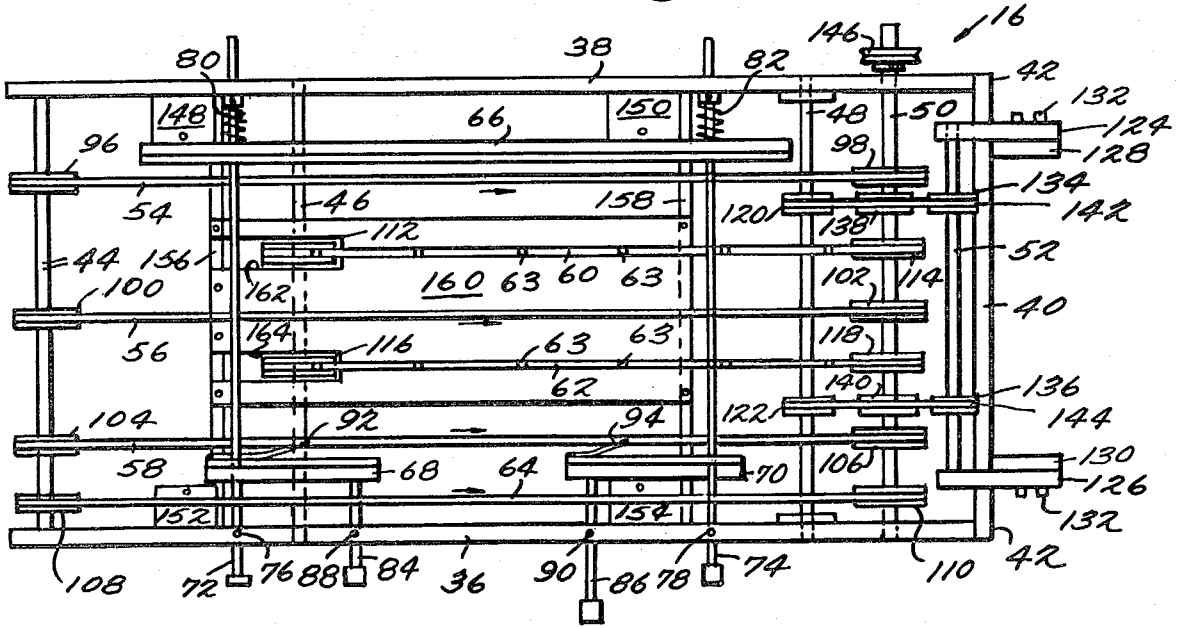
FIG. 4 is a top view of the bottom conveyor assembly as used in the preferred embodiment of the present invention as shown in FIG. 1.

Drive belt 370 extends to a pulley assembly generally indicated at 372 fastened to frame 12 and includes a drive pulley 374 which in turn is connected by means of drive belt 376 to shaft 50 and, in particular, is in driving contact with pulley 146 shown in FIG. 4.

A fourth drive belt 378 extends from and is driven by roller 260 and is connected to a drive pulley 380 and serves to drive the conveyor belts 332 forming part of collection assembly 24. As shown in FIG. 5, drive belt 378 is also passed about gears 382 and 384, each being rotatably secured to vertical member 266.

Drive gear 380 serves to, in turn, power a drive belt 386 which extends around a drive pulley 388 fastened to shaft 318, drive pulley 390 secured to shaft 320 and a tensioning pulley 392. The refold section, generally indicated at 344 and comprising part of the collection assembly 24 is powered by conveyor belts 332 by means of a separate drive pulley 394 which is connected by means of a drive belt 396 to drive pulley 398 secured to drive shaft 324 to which the segmented roller 334 is secured and a tensioning pulley 400. In order to correctly control the refolding of the carrier sheet it is important to have conveyor belts 332 move at a slightly slower rate than the refolding operation so that during refolding carrier sheet and its attached documents will not back up toward the input section of the collection assembly. In order to assure that this occurs, a cam operated clutch generally indicated at 402 of a conventional design is connected to drive pulley 394 and is itself separately mounted to side mounting plate 310 by means of a mounting pin 404.

Turning now to FIG. 10, a terminal strip for connecting the various drive and powering components is set forth. The terminal strip is generally indicated at 410 and is connected to a power supply by means of leads 412. The terminal strip 410 is divided up into a number of sections indicated by references GR, L1, N, L2, T1, T2, SC1, SC2, DC1, DC2, C1 and C2. Power supply leads are connected respectively to terminal strip sections GR, L1, L2 and N and are respectively connected to ground and to a motor speed controller 414, one side of dipole switch 416, the other side of dipole switch 416 and a receptacle or outlet generally indicated at 418. Dipole switch 416 connects transformer 420 to the power supply through strip sections T1 and T2 which, in turn, provides a 220 volt output current along lines 422 to motor speed controller 414 through strip portions SC1 and SC2. The speed controller 414, in turn, controls drive motor 364 to which it is connected through terminal strips DC1 and DC2. Drive motor 364 can, for example, be a Browning one horsepower motor, Model No. 45807372143-5A which is modeled to a gear box, Model E No. 133C1-LR5E. The motor speed controller 414 can be, for example, similar to one manufactured by the Browning Manufacturing Division of the Emerson Electrical Company, Maysville, Ky., Model No. MWP1. Transformer 440 can be of any convenient type and, for example, similar to one manufactured by the General Electric Company, Model No. 9T51B107, Type QB.

A second dipole switch 424 is connected to the power supply through switch 416 via terminal strips T1 and T2 and connects compressor motor 362 to the power supply through connections at terminal strips C1 and C2.

While the invention has been described in connection with what is presently conceived to be the most practical and preferred embodiment, it is to be understood that the invention is not to be limited to the disclosed embodiment but on the contrary, is intended to cover various modifications and equivalent arrangements included within the spirit and scope of the appended claims, which scope is to be accorded the broadest interpretation of such claims so as to encompass all such equivalent structures.

What is claimed is:

1. A gluing machine for gluing documents onto a continuous carrier sheet so that leading documents overlap trailing documents comprising document feed means for individually, successively feeding documents from a stack toward a first path in unlapped relation, first feed means for receiving said unlapped documents and for overlapping said documents so that the trailing portion of leading documents is held spaced above the leading portion of trailing documents while feeding said documents along said first path, second feed means for feeding a continuous carrier sheet along a second path which intercepts the first path at a predetermined point, gluing means for applying glue at predetermined, spaced apart intervals to said carrier sheet, and attachment means for bringing the leading edge of the documents into contact with the glue applied to said carrier sheet.

2. A gluing machine for gluing documents on a continuous carrier sheet in overlapped relation comprising feed means for continuously feeding documents in unlapped fashion from a stack, a document orientation and registration assembly including positioning means for registering documents in the position they are to have when attached to the carrier sheet and for overlapping successively fed unlapped documents so that the trailing portion of leading documents is spaced above the leading portion of trailing documents, gluing means for applying glue on the carrier sheet at predetermined spaced apart intervals, attachment means for bringing the documents into contact with the glue applied on the carrier sheet so that the glued documents are overlapped, and a collection assembly for collecting the carrier sheet after the documents are attached thereto and drive means for driving said machine.

3. An improved document feed and registry device comprising first belt means for receiving, moving and registering documents, said first belt means having a plurality of stop members secured thereto, each of said stop members being spaced a like distance from adjacent ones along the length of said first belt means, second belt means for working with said first belt means to move and register documents, said second belt means being spaced above and movable in the same direction as said first belt means thereby defining a registry zone therebetween, said second belt means having at least a first set of positioning members secured thereon spaced at predetermined intervals along said second belt means so that they enter the registry zone just after said stop members thereby placing a positioning member above the leading portion of each document, each of said positioning members in said first set having touching means for applying vertical pressure on the documents being fed, and horizontal positioning means for maintaining the horizontal positioning of documents as they move through said device.

4. The feed device as claimed in claim 3 wherein said touching means is positioned centrally of said positioning members.

5. The feed device as claimed in claim 3 wherein said second belt means includes a second set of positioning members arranged on said second belt means so as to enter the registry zone a predetermined distance ahead of said stop members.

6. Apparatus for feeding a continuous carrier sheet from a first location and individual documents from a second location for joining said carrier sheet and documents at a third location comprising first feed means for transporting said continuous carrier sheet from said first location to said third location, second feed means for sequentially removing individual documents from said second location and third feed means for sequentially receiving said individual documents from said second feed means and positioning them along a continuous path while continuing to feed them towards said third location, each said document having a leading edge and a trailing edge, said third feed means including edge positioning means for locating the leading edge of each said document in an underlying relationship with respect to the trailing edge of the document that precedes it, said edge positioning means also including raising means for holding said trailing edge out of contact with the leading edge which it overlies, said third feed means further including first belt means having a surface for receiving and supporting said documents and advancing them from said second location toward said third location, said edge positioning means being provided on said first belt means, said third feed means further including second belt means having a surface for receiving and supporting said documents and advancing them from said second location toward said third location, said third feed means also including drive means for driving said first belt means at a first speed and second belt means at a second speed which is greater than said first speed.

7. An apparatus as claimed in claim 6 wherein said third feed means further includes contacting means positioned in spaced relation from the surface defined by said first and second belt means, said contacting means including biasing means for maintaining documents in contact with said surface.

8. An apparatus as claimed in claim 7 wherein said biasing means includes at least one rotatable ball.

9. An apparatus as claimed in claim 8 and including third belt means carrying said contacting means and third drive means for moving said contacting means in a direction from said second location toward said third location.

10. An apparatus as claimed in claim 7 wherein said biasing means is positioned in the path of movement of said second belt means.

11. Apparatus for feeding a continuous carrier sheet from a first location and individual documents from a second location for joining said carrier sheet and documents at a third location comprising first feed means for transporting said continuous carrier sheet from said first location to said third location, second feed means for sequentially removing individual documents from said second location and feeding said documents in unlapped relation and third feed means for sequentially receiving said individual, unlapped documents from said second feed means and positioning them along a continuous path while continuing to feed them toward said third location, each said document having a leading edge and a trailing edge, said third feed means including edge positioning means for locating the leading edge of each said document in an underlying relationship with respect to the trailing edge of the document that precedes it, said edge positioning means also including raising means for holding said trailing edge out of contact with the leading edge which it overlies.

12. An apparatus as claimed in claim 11 wherein said third feed means includes first belt means having a surface for receiving and supporting said documents and advancing them from said second location toward said third location, said edge positioning means being provided on said first belt means.

13. An apparatus as claimed in claim 12 or 6 wherein said edge positioning means includes a plurality of stop members positioned at spaced intervals along said first belt means, each said stop member having an abuttment surface for receiving and locating the leading edge of a document, the distance between leading edges of adjacent stop members being less than the distance between the leading and trailing edges of a document.

14. An apparatus as claimed in claim 13 wherein each said stop member has a portion spaced above said first belt means by a distance greater than the thickness of the individual documents, said portion defining said raising means.

15. A gluing machine for gluing documents onto a continuous carrier sheet, said carrier sheet being divided into sections by fold lines comprising feed means for individually, successively feeding the documents in unlapped relation, a continuously moving first belt means having a surface for receiving said documents fed by said feed means, said first belt means having a plurality of stop members secured thereto, the distance between said stop members being less than the length of the documents, the leading edge of each said document fed by said feed means abutting against a stop as the documents are received by said first belt means, the trailing edge of each document overlying the following stop on said first belt means so that the trailing edge of each leading document overlies the leading edge of the document that follows it, gluing means for applying glue to alternate sections of said continuous carrier sheet and contact means for bringing the leading edge of each document into contact with said glue so that the documents are mounted on the carrier sheet on alternating sections thereof, the mounted documents being in overlapped relation when affixed to said carrier sheet.

16. The gluing machine as claimed in claim 15, further comprising second belt means for moving each document forward as it is fed by said feed means to abut against one of said stops.

17. The gluing machine as claimed in claim 15 or 16, further comprising biasing means spaced from the surface defined by said first belt means for maintaining documents in contact with said surface.

* * * * *

UNITED STATES PATENT AND TRADEMARK OFFICE

CERTIFICATE OF CORRECTION

PATENT NO. : 4,373,986

DATED : February 15, 1983

INVENTOR(S) : Clendon W. Cone

It is certified that error appears in the above-identified patent and that said Letters Patent is hereby corrected as shown below:

The term of this patent subsequent to June 2, 1998 has been disclaimed.

Signed and Sealed this

*Twenty-fourth* Day of *May 1983*

[SEAL]

*Attest:*

DONALD J. QUIGG

*Attesting Officer*

*Acting Commissioner of Patents and Trademarks*